United States Patent [19]

Behrend

[11] 4,390,127

[45] Jun. 28, 1983

[54] SPRAYING GUN FOR METAL SPRAYING

[76] Inventor: Paul Behrend, Sonnenbergstrasse 53, D-6508 Alzey 3, Fed. Rep. of Germany

[21] Appl. No.: 245,266

[22] Filed: Mar. 19, 1981

[30] Foreign Application Priority Data

Apr. 14, 1980 [DE] Fed. Rep. of Germany ..... 3014177

[51] Int. Cl.[3] ..... B05B 1/24

[52] U.S. Cl. ..... 239/83

[58] Field of Search ..... 239/82, 83, 85, 79

[56] References Cited

U.S. PATENT DOCUMENTS

| | | | |
|---|---|---|---|
| 1,880,331 | 4/1932 | Rapp | 239/82 |
| 2,225,168 | 12/1940 | Forton | 239/82 |
| 2,530,186 | 11/1950 | Trimm et al. | 239/82 |
| 2,541,775 | 2/1951 | Miller | 239/82 |
| 2,585,560 | 2/1952 | Larsson | 239/82 |

FOREIGN PATENT DOCUMENTS

| | | | |
|---|---|---|---|
| 166811 | 5/1953 | Australia | 239/82 |

*Primary Examiner*—John J. Love
*Assistant Examiner*—Michael J. Forman
*Attorney, Agent, or Firm*—Wallenstein, Wagner, Hattis, Strampel & Aubel

[57] ABSTRACT

A spraying gun for spraying molten metals consisting of a housing, a heatable container for the material to be sprayed, an adjustable spraying nozzle, a handle and actuating rods to open and close inlets for pressurized air and heating gas in which the gas heated container is provided within the housing in a manner that the end of the container is located within a burning chamber adjacent to the end of the gas burner. The housing is thermally isolated from the handle with the actuating lever preferably by silicone rubber or polytetrafluoroethylene layers. The spraying nozzle is regulated by a needle valve which is adjusted by a micrometer screw.

3 Claims, 1 Drawing Figure

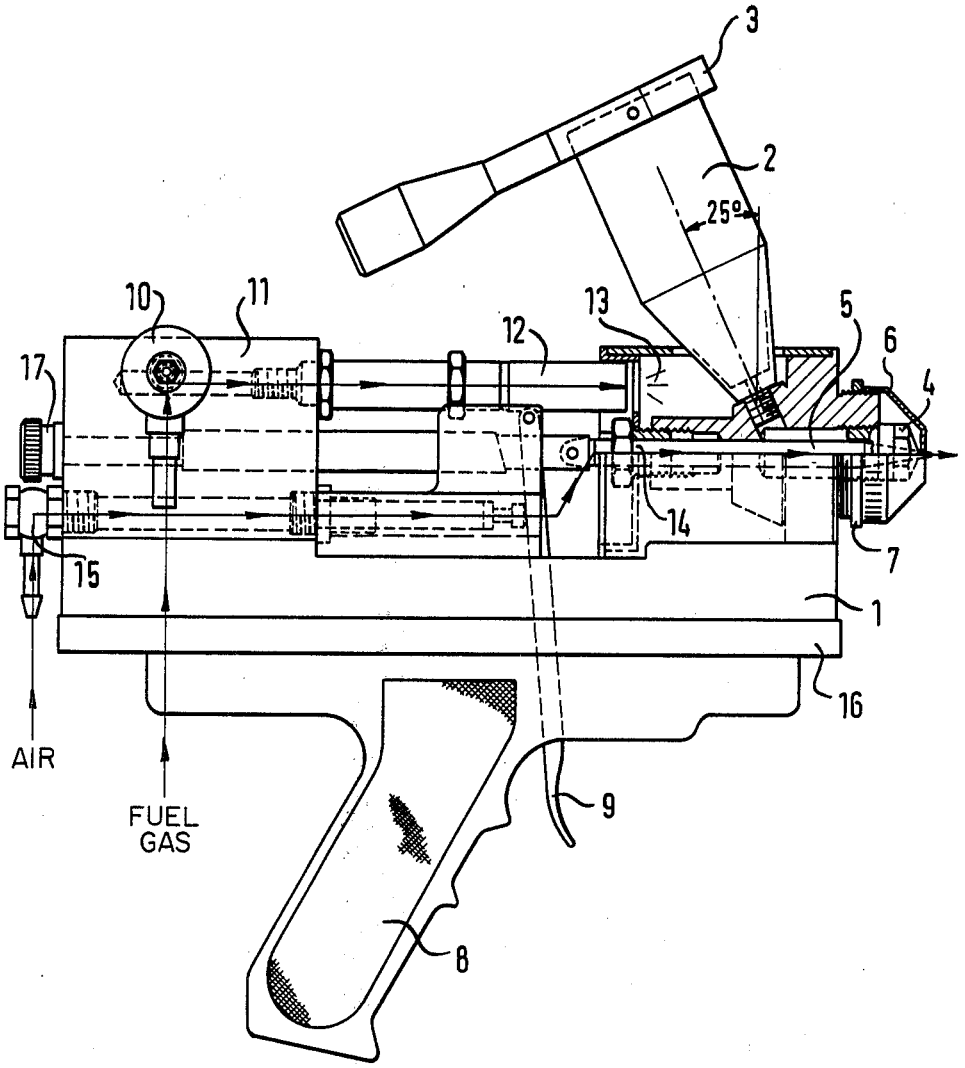
3
2
25°
10
11
12
13
5
6
4
17
14
7
15
1
16
AIR
FUEL
GAS
9
8

SPRAYING GUN FOR METAL SPRAYING

BACKGROUND OF THE INVENTION

A metal spraying gun as described in German published patent application Pat. No. 28 15 648.1 uses an electric heating system to produce a metal melt which system comprises a steel container having thin walls which are surrounded by a thick block of a thermally conductive metal such as an aluminum alloy. The block contains an electric heating element as well as a thermocouple and air channels. The molten metal is sprayed by using pressurized air. However the heating system is rather complicated and does not allow for quick heating operations. Another spraying gun as described in Swiss Pat. No. 603,250 comprises a container for molten metal having double walls between which the pressurized air is heated by a gas flame.

The gas burner is located underneath the container and forms a separate system which is fixed to the rest of the gun by simple screw connections. This device needs special care when used because the gas burner appears to be dangerous and the oxidizing action of the gas flame is in no way shielded from the metal to be sprayed.

DESCRIPTION OF THE INVENTION

It has been found that a gas heated metal spraying gun may be provided which is safer to handle and is of a simple construction to allow for less dangerous spraying under non-oxidizing conditions.

The spraying gun for spraying molten metals of the invention comprises a housing, a gas heatable container for the material to be sprayed, an adjustable nozzle, a handle and actuating rods to open and to close inlets for pressurized air and heating gas, said spraying gun being characterized in that the gas heated container is provided within the housing in a manner that the bottom of the container is located within a burning chamber adjacent to the end of the gas burner.

In particular the gas heating device comprises a gas inlet valve, a gas burner and a burner tube ending in the burning chamber into which the container for molten metal extends. The axis of the container for molten metal preferably forms an angle of about 25° to the normal to the axis of the spraying nozzle. In this manner the container for molten metal may be heated very well by the gas heating device. By locating the source of pressurized air near the burning chamber it is possible to make cleaning of the device after spraying superfluous. This construction feature of the spraying gun is therefore preferred. Small metal residues are pressed out of the nozzle by the preheated air without difficulties.

A further preferred feature of the invention provides for a housing which is separated from the handle by a layer of heat insulating material Preferably this layer consists of silicone rubber and/or polytetrafluorethylene or a combination thereof. This allows that the handle is heated only slightly whereas the housing may become rather warm when spraying molten metal.

In order to allow for adding fresh metal during the spraying process the container for molten metal is provided with a cover having a handle.

Further the nozzle is provided with a needle valve which is adjustable by a micrometer screw and allows for fine regulating the spray. The rough regulation of the nozzle is carried out by a ring connected with the nozzle.

The spraying gun of the invention is further described and explained by reference to the drawing.

According to the figure the spraying gun comprises a housing 1 into which a container 2 for molten metal is inserted in a preferred manner to allow for an angle of the container axis of about 25° with respect to the normal to the axis of the nozzle. The container 2 for molten metal is provided with a cover 3 which is provided with a heat insulated handle in order to allow for replacing metal during the spraying process. The nozzle 4 contains a needle valve 5 which is connected with a micrometer screw 17 at the far end of the housing by a rod system which allows for for fine regulation of the nozzle opening. The air chamber of the nozzle 4 is covered by a lid 6.

The handle 8 with operating lever 9 of the gun is provided below the housing 1 and is separated from the housing 1 by a heat insulating layer 16. This allows that the handle does not become warmer than about 30° C. whereas the housing may be warmer. The operating lever 9 opens and closes pressurized air in sub 15 to the spraying nozzle.

Pressurized air outlet 14 is located below the burning chamber 13 into which the container 2 for molten metal extends.

The gas heating device itself consists of the gas burner nozzle 11 which is actuated by a gas valve 10. The flame is directed via the burner tube 12 into the burning chamber 13.

When actuating the metal spraying gun of the invention first the container cover 3 is removed and the spray material which is preferable in the form of rods (measuring, e.g. 25 mm×50 mm) is put into the container. Then the gas inlet valve 10 is opened and the gas is lighted at the burner 12. After a preheating period of some minutes spraying may be started. The fine regulation of the spray takes place when operating the micrometer screw 17.

The regulation of pressurized air may be carried out by arresting the cover 6 of the spraying nozzle by means of the ring 7.

The pressurized air having not much more than about 2 kg/cm$^2$ pressure is fed at air input 15. By the lever 9 air inlet 14 and subsequently nozzle needle 5 are opened and spraying is started.

By using the metal spraying gun of the invention metals or metal alloys with melting points up to about 400° C. may be sprayed. The simple construction allows for an undisturbed spraying of very fine metal layers. It is possible to even coat wax models with metal and to make copies from such models. The thickness of material to be sprayed depends from the surface of the model used. By arranging burner and pressurized air in the manner as shown in the spraying gun of the invention spraying air is preheated in order to prevent clogging of the nozzle.

The housing of the spraying gun of the invention is preferably made of a vanadium containing steel or a heat resistant aluminium alloy.

I claim:

1. A metal spraying gun comprising: a unitary housing; a handle for the housing; a heat insulating layer between the housing and the handle to prevent the passage of heat from the housing to the handle; an adjustable spray nozzle having an outlet positioned at the forward end of the housing; a fuel gas burning chamber in the housing positioned above and rearwardly of the spray nozzle; a heatable container for the material to be sprayed through the nozzle, said container being carried at an angle at the forward end of the housing rearwardly of the spray nozzle and having one end thereof extending into the gas burning chamber of the housing; a gas heating device positioned in the housing rearwardly with relation to the gas burning chamber, said gas heating device including a fuel gas inlet valve at the rear of the housing connectable to a source of fuel gas and a longitudinally extending gas burner tube in communication with the fuel gas inlet valve and the gas burning chamber; a single, longitudinally extending pressurized air passageway in the housing positioned below the gas heating device for entraining material from the heatable container, said passageway being in communication with pressurized air inlet means at the rear of the housing and with a pressurized air chamber positioned in the housing rearwardly of the spray nozzle; a needle valve extending parallel to the longitudinal axis of the housing from a rear portion of the housing to the nozzle outlet for controlling the flow of material through the nozzle; a pressurized air control valve in the housing in communication with the pressurized air source and the pressurized air chamber for regulating the flow of pressurized air to the nozzle outlet and trigger means adjacent to the handle for actuating the pressurized air control valve and subsequently the longitudinally extending needle valve.

2. Metal spraying gun as claimed in claim 1 characterized in that the axis of the container (2) for the material to be sprayed forms an angle of about 25° with the perpendicular to the spraying nozzle axis.

3. Metal spraying gun as claimed in claim 1 characterized in that the thermally insulating layer (16) consists of silicone rubber and/or polytetrafluorethylene.

* * * * *